US010738942B2

(12) United States Patent
Philippe et al.

(10) Patent No.: US 10,738,942 B2
(45) **Date of Patent: *Aug. 11, 2020**

(54) SEALED AND THERMALLY INSULATED TANK

(71) Applicant: GAZTRANSPORT ET TECHNIGAZ, Saint Remy les Chevreuse (FR)

(72) Inventors: Antoine Philippe, Gif sur Yvette (FR); Johan Bougault, Jouy en Josas (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 220 days.

This patent is subject to a terminal disclaimer.

(21) Appl. No.: 14/784,263

(22) PCT Filed: Apr. 11, 2014

(86) PCT No.: PCT/FR2014/050882
§ 371 (c)(1),
(2) Date: Oct. 13, 2015

(87) PCT Pub. No.: WO2014/170588
PCT Pub. Date: Oct. 23, 2014

(65) Prior Publication Data

US 2016/0076701 A1 Mar. 17, 2016

(30) Foreign Application Priority Data

Apr. 15, 2013 (FR) ..... 13 53373

(51) Int. Cl.
*F17C 3/02* (2006.01)
*B63B 3/20* (2006.01)
(Continued)

(52) U.S. Cl.
CPC ..... *F17C 3/027* (2013.01); *B63B 3/20* (2013.01); *B63B 27/34* (2013.01); *B63B 35/003* (2013.01);
(Continued)

(58) Field of Classification Search
CPC .... F17C 3/027; F17C 9/00; F17C 6/00; F17C 2201/0157; F17C 2201/052;
(Continued)

(56) References Cited

U.S. PATENT DOCUMENTS 3,760,971 A * 9/1973 Sterrett ..... B65D 81/3811 114/74 A
6,374,761 B1 * 4/2002 Dhellemmes ..... B63B 3/68 114/74 A
(Continued)

FOREIGN PATENT DOCUMENTS

FR 2798901 A1 3/2001
FR 2887010 A1 12/2006

OTHER PUBLICATIONS

International Search Report for PCT/FR2014/050882 Filed on Apr. 11, 2014.

*Primary Examiner* — Anthony D Stashick
*Assistant Examiner* — James M Van Buskirk
(74) *Attorney, Agent, or Firm* — Notaro, Michalos & Zaccaria P.C.

(57) ABSTRACT

A sealed and thermally insulating tank whose wall is fixed to a carrier wall. The tank wall includes a secondary thermal insulation barrier which is retained on the carrier wall and a secondary sealing barrier which is supported by the thermal insulation barrier. There is also a primary insulation barrier which is fixed to the secondary element of the tank by a fastener which is connected to the secondary insulation barrier.

8 Claims, 6 Drawing Sheets

(51) Int. Cl.

| | |
|---|---|
| ***B63B 27/34*** | (2006.01) |
| ***B63B 35/00*** | (2020.01) |
| ***B65D 88/54*** | (2006.01) |
| ***F17C 6/00*** | (2006.01) |
| ***F17C 9/00*** | (2006.01) |

(52) U.S. Cl.
CPC ..... *B65D 88/54* (2013.01); *F17C 6/00* (2013.01); *F17C 9/00* (2013.01); *F17C 2201/0157* (2013.01); *F17C 2201/052* (2013.01); *F17C 2203/0329* (2013.01); *F17C 2203/0333* (2013.01); *F17C 2203/0354* (2013.01); *F17C 2203/0358* (2013.01); *F17C 2203/0631* (2013.01); *F17C 2205/018* (2013.01); *F17C 2205/0153* (2013.01); *F17C 2209/228* (2013.01); *F17C 2221/033* (2013.01); *F17C 2223/0161* (2013.01); *F17C 2223/033* (2013.01); *F17C 2260/01* (2013.01); *F17C 2270/0107* (2013.01)

(58) Field of Classification Search
CPC ..... F17C 2203/0333; F17C 2201/0354; F17C 2201/0358; F17C 2201/0631; F17C 2201/0329; F17C 2205/018; F17C 2205/0153; F17C 2209/228; F17C 2223/0161; F17C 2223/033; F17C 2260/01; F17C 2270/0107; B63B 27/34; B63B 3/20; B63B 35/003; B65D 88/54
USPC ..... 114/256; 220/592.25
See application file for complete search history.

(56) References Cited

U.S. PATENT DOCUMENTS

| | | | | |
|---|---|---|---|---|
| 8,985,042 | B2 * | 3/2015 | Canler | F17C 3/027 114/74 A |
| 2014/0124086 | A1 * | 5/2014 | Jean | F17C 3/027 141/1 |

* cited by examiner

SEALED AND THERMALLY INSULATED TANK

The present invention relates to a sealed and thermally insulating tank; in particular, the present invention relates to tanks which are intended to contain cold liquids, for example, tanks for the storage and/or transport of liquefied gases via the sea.

Sealed and thermally insulating tanks may be used in different industries to store hot or cold products. For example, in the field of energy, liquefied natural gas (LNG) is a liquid which can be stored at atmospheric pressure at approximately −163° C. in land-based storage tanks or in on-board tanks in floating structures.

Such a tank was described, for example, in document FR-A-2887010. This document describes a tank which comprises a primary sealing barrier which is intended to be in contact with the product contained in the tank, a secondary sealing barrier which is arranged between the primary sealing barrier and the carrier structure, a primary thermally insulating barrier between the two sealing barriers, a secondary thermally insulating barrier between the secondary sealing barrier and the carrier structure, the tank comprising primary and secondary retention means in order to retain the elements of the primary and secondary insulation barriers on the carrier structure. The primary retention means are independent of the secondary retention means; plates are retained on the upper panels of the secondary heat-insulation elements in order to retain the elements of the primary insulation barrier on the carrier structure via the secondary heat-insulation elements. It should be noted that, in this embodiment, the fixing means for fixing the primary heat-insulation elements on the secondary barrier are supported on the upper side of the base plate, which delimits the primary insulation blocks; that is to say, the primary heat-insulation element is clamped and rubs significantly against the secondary sealed barrier, which limits the possibility of any clearance between the primary insulation blocks and the secondary sealing barrier.

A notion on which the invention is based is to provide a sealed and insulating multi-layer structure which allows a freedom of movement of the insulation blocks of the primary element relative to the secondary element parallel with the carrier wall, although the primary blocks are retained relative to the carrier wall by means of the secondary insulation layer. This aspect is particularly important when the sealing membranes are provided with undulations in at least two orthogonal directions parallel with the sides of the insulation blocks in order to enable local contractions or expansions.

According to an embodiment, the invention provides for a sealed and thermally insulating tank which is integrated in a structure which comprises a carrier wall, the tank comprising a tank wall which is fixed to the carrier wall, the tank wall comprising, on the one hand, a primary element and, on the other hand, a secondary element which is arranged between the carrier wall and the primary element, each of the primary and secondary elements including, on the one hand, a thermal insulation barrier which is constituted by insulation blocks in the form of rectangular parallelepipeds which are juxtaposed in parallel rows which are each delimited by two rigid plates which are substantially parallel with the carrier wall in the zone in the region of which they are located and, on the other hand, a sealing barrier which is arranged on each of the thermal insulation barriers, the thermal insulation barrier of the secondary element being fixedly joined to the carrier wall, the thermal insulation barrier of the primary element being fixedly joined to the secondary element of the tank by fastening means which are connected to the thermal insulation barrier of the secondary element, and allowing the primary insulation blocks of the primary element of the tank wall to be pressed onto the secondary insulation blocks of the secondary element of the tank wall, the fastening means comprising:

a metal plate which is fixed in a countersink of a rigid plate of a primary insulation block which is adjacent to the secondary sealing barrier, the countersink being at the side of the secondary sealing barrier, the metal plate comprising at least one retention zone, and a protruding member which is connected via the base thereof to a secondary insulation block which is located in the region of the plate, the protruding member having a threaded head in order to cooperate with a nut, whose screwing directly or indirectly applies to the retention zone of the plate a force in the direction of the carrier wall.

According to different embodiments, such a tank may further comprise one or more of the following features.

According to an embodiment, an insulation block of a thermal insulation barrier comprises a layer of plastics material foam which is clamped between two rigid insulating plates.

According to an embodiment, the fastening means comprise a connection arm which connects the retention zone of the plate to the protruding member, the connection arm comprising a retention zone which is in engagement with a stack of resilient washers which are engaged on the protruding member, the nut being screwed above the stack of resilient washers.

According to an embodiment, four adjacent primary insulation blocks each comprise, in the region of a corner adjacent to the other three primary insulation blocks, a metal plate which is fixed in a countersink of a rigid plate of the primary insulation block which is adjacent to the secondary sealing barrier, the countersink being at the side of the secondary sealing barrier, the metal plate comprising at least one retention zone.

According to an embodiment, the fastening means comprise a cruciform plate which comprises four connection arms which connect the retention zone of the plate of a primary insulation block to the protruding member, respectively, the cruciform plate comprising a retention zone which is in engagement with the protruding member, the nut being screwed above the retention zone of the cruciform plate.

According to an embodiment, each branch of the cruciform plate comprises a bending zone so that the retention of the primary insulation blocks is carried out in a resilient manner.

According to an embodiment, the retention zone of the metal plate comprises a threaded stud, which is welded to the metal plate which extends through an end portion of the connection arm and a nut cooperates with the thread of the stud in order to fix the end portion of the connection arm to the primary insulation block.

According to an embodiment, the plate of a primary insulation block comprises a disk which is arranged in the countersink of the rigid plate of the primary insulation block and a lug which protrudes out of the countersink whilst remaining in the plane of the disk, the end of the lug constituting the retention zone of the plate, the zone supporting a stack of resilient washers which are engaged on the protruding member, the base of the stack of washers being a serrated disk whose slots enable the passage of the lug.

According to an embodiment, four adjacent primary insulation blocks each comprise, in the region of a corner adjacent to the other three primary insulation blocks, a metal plate which is fixed in a countersink of a rigid plate of the primary insulation block adjacent to the secondary sealing barrier, the countersink being at the side of the secondary sealing barrier, the metal plate each time comprising a lug which protrudes out of the countersink whilst remaining in the plane of the disk, the end of the lug constituting the retention zone of the plate, and in which the slots of the serrated disk enable the passage of the four lugs which correspond to the four primary insulation blocks.

According to an embodiment, four adjacent primary insulation blocks each comprise, in the region of a corner adjacent to the other three primary insulation blocks, a metal plate which is fixed in a countersink of a rigid plate of the primary insulation block adjacent to the secondary sealing barrier, the countersink being at the side of the secondary sealing barrier, said metal plate comprising a central hole each time, in which said fastening means comprise a spacer plate which is perforated at the center thereof so that the protruding member which is constituted by a pin which is threaded at the free end thereof can extend through it in order to cooperate with a nut, the base of the pin being welded to the center of a plate which is screwed into a countersink of a rigid plate of a secondary insulation block, the plate being covered by the secondary sealing barrier which is welded to it all the way around the pin in order to ensure the secondary sealing, the clamping of the nut of the pin applying to the spacer plate, via a stack of resilient washers, a force in the direction of the carrier wall in order to press the spacer plate onto the secondary sealing barrier, the spacer plate comprising four secondary pins which are engaged in the central hole of the four metal plates, respectively, secondary nuts being screwed to the secondary pins in order to clamp the metal plate in the direction of the spacer plate each time.

According to an embodiment, four adjacent primary insulation blocks each comprise, in the region of a corner adjacent to the other three primary insulation blocks, a metal plate which is fixed in a countersink of a rigid plate of the adjacent primary insulation block of the secondary sealing barrier, the countersink being at the side of the secondary sealing barrier, the metal plate each time comprising a central hole, the fastening means comprising four threaded pins which are engaged in the central hole of the four metal plates, respectively, each threaded pin being welded via the base thereof to a plate which is screwed into a countersink of the rigid plate of the secondary insulation block, the threaded pin extending through the secondary sealing barrier and the secondary sealing barrier being rewelded to the plate all the way around the pin in order to reestablish the sealing, a nut cooperating with the thread of the pin in order to apply to the plate which corresponds to it, via a stack of resilient washers, a force which is directed toward the carrier wall.

According to an embodiment, four adjacent primary insulation blocks each comprise, in the region of a corner adjacent to the other three primary insulation blocks, a metal plate which is fixed in a countersink of a rigid plate of the primary insulation block adjacent to the secondary sealing barrier, the countersink being at the side of the secondary sealing barrier, the metal plate comprising each time a centering stud which is directed toward the inner side of each primary insulation block, the stud permitting the introduction at that location of resilient washers which are surmounted by a disk with a central perforation on which a hollow cylindrical foot which is centered on the centering stud presses, and in which the fastening means comprise a counter-plate to which the four hollow cylindrical feet are fixedly joined, each time via an end of the foot opposite the one which allows centering on the stud, the counter-plate having a central indentation and being placed above the primary insulation blocks, the central indentation having the base thereof perforated in order to ensure the passage of the protruding member whose base is fixedly joined to a plate which is screwed into a rigid plate of the secondary insulation block.

According to an embodiment, the metal sheets of the metal membrane each comprise at least two orthogonal undulations which are parallel with the sides of the thermal insulation blocks, the undulations being inserted into the gaps which are provided between the insulation blocks.

According to an embodiment, the adjacent metal sheets of a sealing barrier are lap-welded.

Such a tank may be part of a land-based storage installation, for example, for storing LNG, or be installed in a floating structure, at the coast or in deep water, in particular an LNG tanker, a floating storage or regasification unit (FSRU), a floating production, storage and offloading unit (FPSO) and the like.

The invention therefore also relates to a tanker for the transport of a cold liquid product, which comprises a double hull and a tank as defined above arranged in the double hull.

The invention also provides for a method for loading or unloading such a tanker, in which a cold liquid product is conveyed through insulated channels from or to a land-based or floating storage installation to or from the tank of the tanker.

According to an embodiment, the invention also provides a transfer system for a cold liquid product, the system comprising the above-mentioned tanker, insulated channels which are arranged in order to connect the tank which is installed in the hull of the tanker to a floating or land-based storage installation and a pump for entraining a flow of cold liquid product through the insulated channels from or to the floating or land-based storage installation to or from the tank of the tanker.

The invention will be better understood and other objects, details, features and advantages thereof will be appreciated more clearly from the following description of a plurality of specific embodiments of the invention, given purely by way of non-limiting illustration, with reference to the appended drawings.

Figure 1:
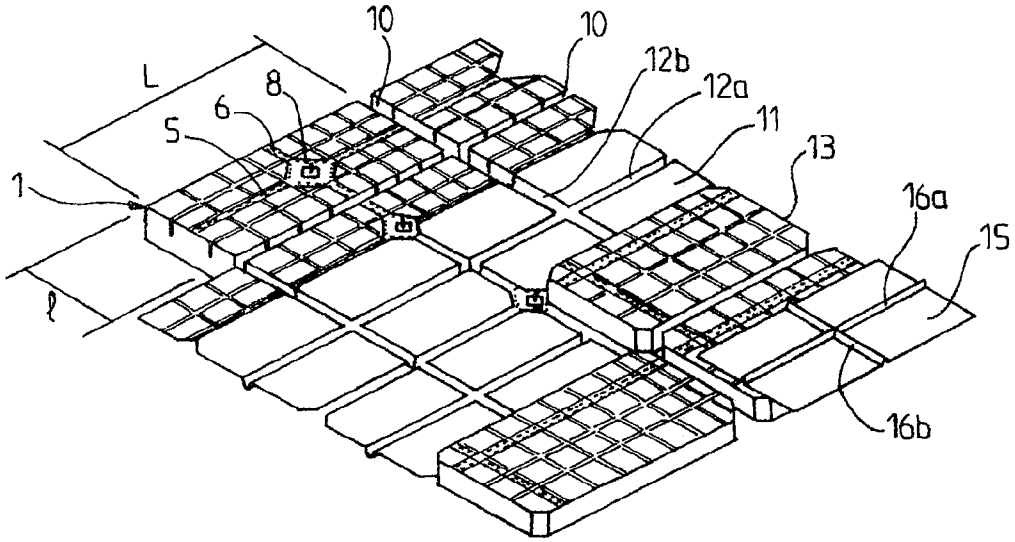
FIG. 1 is a schematic, perspective view of an assembly of the different members which constitute a sealed and thermally insulating tank wall according to an embodiment of the invention; this general view comprises broken-away portions in order to enable the thermal insulation and sealing barriers of the secondary and primary elements of the tank wall to be seen.
Figure 2:
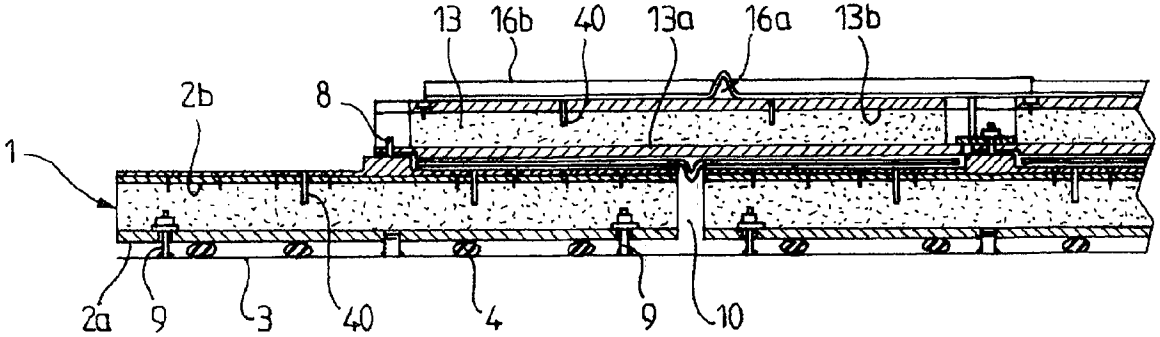
FIG. 2 is a schematic cross section of a tank wall of FIG. 1, whose primary sealing barrier comprises folds which protrude at the side opposite the carrier wall and whose secondary sealing barrier comprises protruding folds which are directed toward the carrier wall.

With reference to the drawings and more specifically FIGS. 1 and 2, it can be seen that an insulation block of the thermal insulation barrier of the secondary element of a tank wall is generally designated 1. This block has a length L and a width I, for example, 3 m and 1 m, respectively; it has a rectangular parallelepipedal shape and it is constituted by a polyurethane foam which is contained between two plates 2*a*, 2*b* of plywood. One of the plates 2*a* is intended to face the carrier wall 3 with beads of resin 4 which enable the local defects of the carrier wall 3 to be compensated for being interposed. The plate 2*a* is held on the carrier wall 3 by means of adhesive bonding using resin beads 4 and by means of pins 9 which are welded to the carrier wall 3.

In FIG. 1, it can be seen that, starting from the secondary insulation block which is uncovered and which is illustrated at the top left-hand side of the Figure and which extends downward and to the right in an oblique direction, the perspective view shows a secondary insulation block 1 which is partially covered by a metal sheet 11 which constitutes a portion of the secondary sealing barrier of the tank wall. This metal sheet 11 is substantially rectangular and it comprises, along each of the two axes of symmetry of this rectangle, an undulation 12*a*, 12*b*, respectively. The undulations 12*a* and 12*b* form reliefs which are arranged in the direction of the carrier wall 3 and they are accommodated in the gaps 10 of the secondary insulation barrier.

The adjacent metal sheets of the sealing barriers of the primary and secondary elements are lap-welded in the region of connection strips which are carried by the thermal insulation barriers of the primary and secondary elements, respectively. The fastening means on the thermal insulation barrier of the primary element are provided in the region of the intersection of the two connection strips of each insulation block of the secondary element and extend through the region of the sealing barrier of the secondary element without rising in the region of the sealing barrier of the primary element. Said fastening means are pins 8 whose base is welded to the connection strips of the secondary element and which extend through the sealing barrier of the secondary element in the region of the lap-welding zone of two adjacent sheets of the sealing barrier, the intermediate components being interposed between, on the one hand, a nut which cooperates with the thread provided at the free end of the pin and, on the other hand, the protruding portions of the plates of the insulation blocks of the thermal insulation barrier of the primary element.

The metal sheets may be produced from Invar®, whose thermal expansion coefficient is typically between $1.5.10^{-6}$ and $2.10^{-6}$ $K^{-1}$; they have a thickness of between approximately 0.7 mm and approximately 0.4 mm. According to a preferred embodiment, the metal sheets are produced from an alloy based on manganese which has a thermal expansion coefficient substantially equal to $7.10^{-6}$ $K^{-1}$. Such an alloy is generally less costly than the alloys which have a high nickel content such as Invar®.

With reference again to FIG. 1, from the zone where the metal sheets 11 of the sealing barrier of the secondary element of the tank wall are positioned and moving in an oblique manner to the right and downward, it can be seen that a zone has been illustrated in which the secondary sealing barrier is covered with an insulation block 13 of the thermal insulation barrier of the primary element of the tank wall.

This insulation block 13 has a general structure which is similar to that of the block 1, that is to say, it is a sandwich which is constituted by a polyurethane foam between two plywood plates. The base plate 13*a* is in abutment with a metal sheet 11.

Finally, FIG. 1 shows, when moving from an element 13 in an oblique manner downward and to the right, the positioning of a metal sheet 15 which constitutes the sealing barrier of the primary element of the tank. This metal sheet 15 may be produced from stainless steel having a thickness of approximately 1.2 mm; it comprises undulations along the axes of symmetry of the rectangle which it constitutes, as has already been indicated for the metal sheets 11. These undulations may be in relief at the side of the carrier wall 3, but they may also be in relief toward the inner side of the tank; these undulations have been designated 16*a*, 16*b*. In FIG. 2, the undulations 16*a*, 16*b* are directed toward the inner side of the tank.

For the description of some embodiments of the fastening means of FIGS. 3 to 7, the same reference numerals have been retained to refer to elements which are identical or similar, optionally appended with the letters a, b or c in accordance with the variants described.

Figure 3:
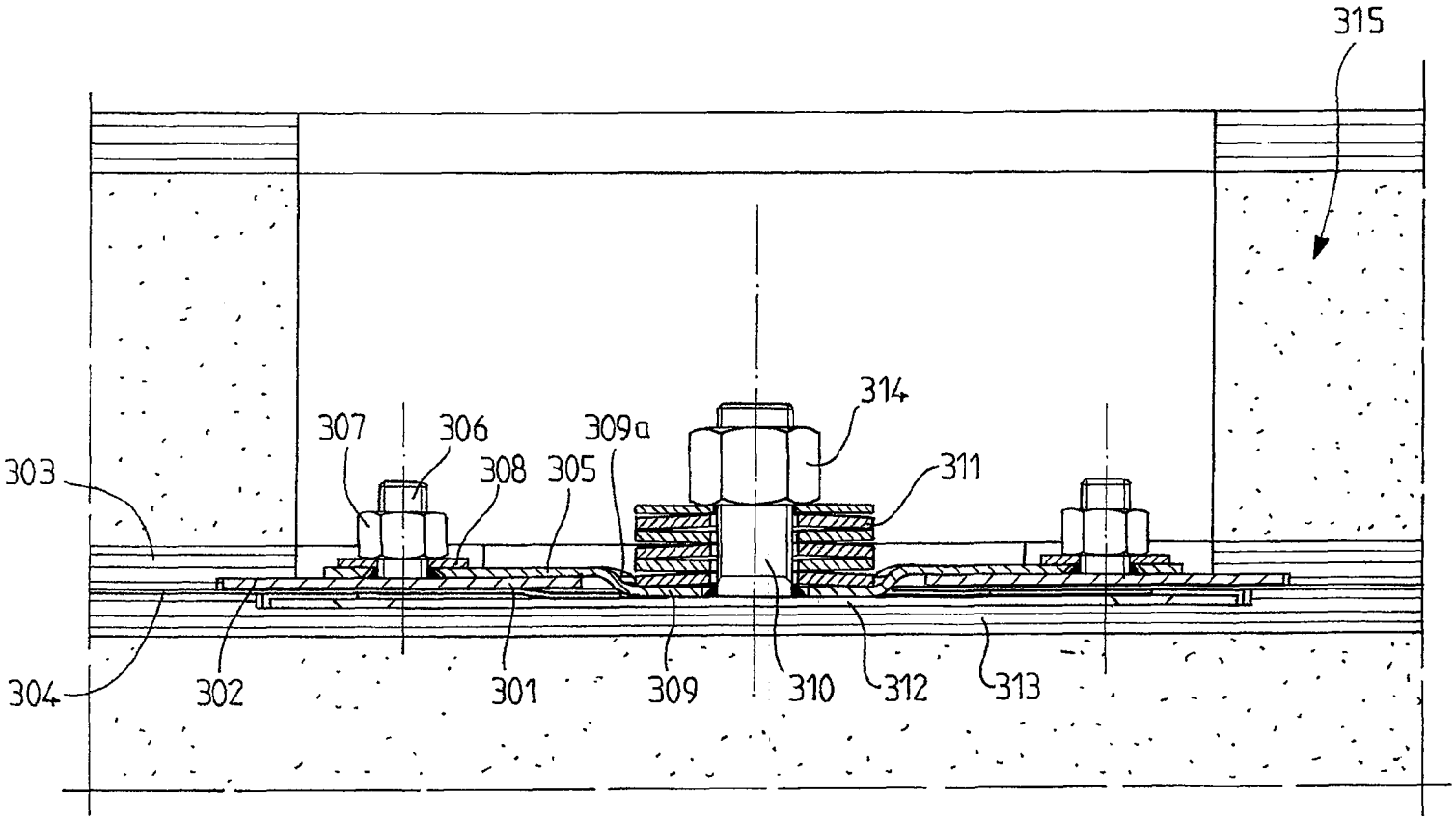
FIG. 3 shows in cross section perpendicularly to the carrier wall a first embodiment of the fastening means in a zone in which the meeting point of four adjacent primary insulation blocks is located.

With reference to FIG. 3, an embodiment of fastening means will now be described in which a metal plate in the form of a disk 301 is retained below the four adjacent corners of four adjacent primary insulation blocks. The disk 301 is arranged in a countersink 302 of the rigid plate 303 of a primary insulation block adjacent to the sealing barrier 304. The connection arm 305 produces a mechanical connection of the disk 301 to the central pin 310, this connection being obtained by means of a threaded pin 306 to which there is screwed a nut 307 which abuts the distal end of the arm 305 via a washer 308. The pin 306 is welded to the base thereof on the disk 301. The connection arm 305 comprises, in the direction away from the pin 306, a bending 309*a* which enables it to be moved to a lower level in order to form the retention zone 309 of the arm 305. A protruding member 310 which is welded via the base thereof to a plate 312 which is placed in a countersink of the rigid plate 313, which delimits a secondary insulation block at the side at which the sealing barrier 304 is located, passes through the retention zone 309. The protruding member 310 is a pin whose free end is threaded in order to cooperate with a nut 314 with a stack of resilient washers 311 being interposed. The clamping of the nut 314 enables the primary insulation block 315 to be pressed onto the secondary insulation barrier. It is clear that the retention of the primary insulation barrier is carried out in this variant from below the rigid base plates of the primary insulation blocks 315.

Figure 3A:
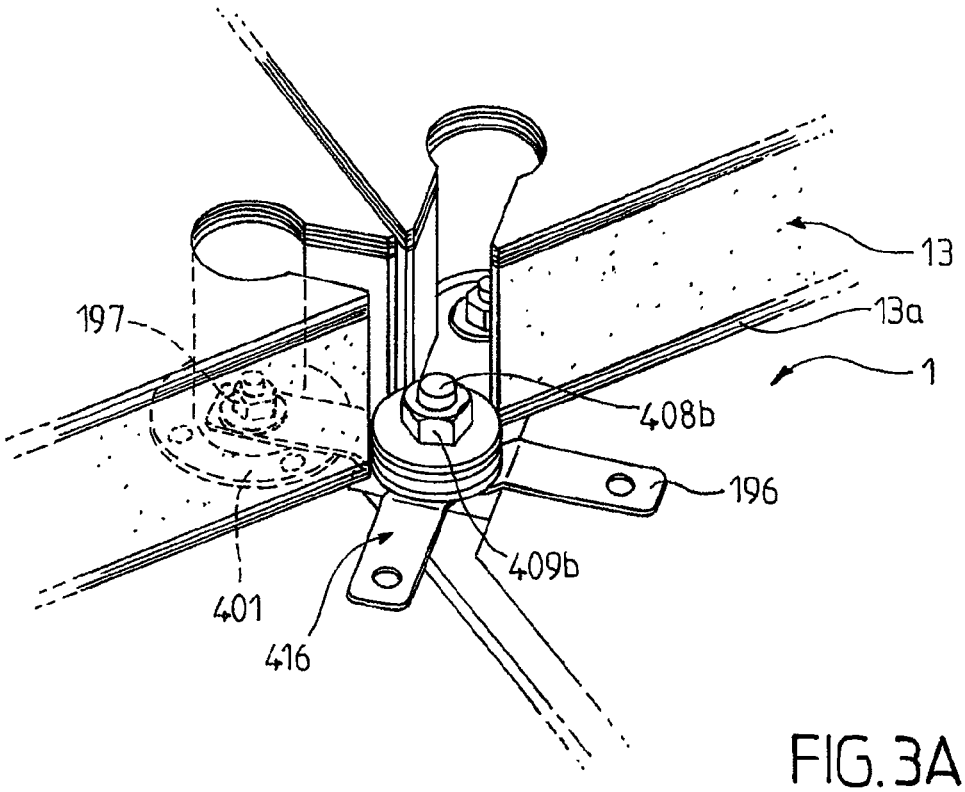
FIGS. 3A and 3B are perspective views of the variants of FIG. 3 showing the recesses which are formed in the primary insulation blocks in order to accommodate the constituents of the fastening means.

With reference now to FIG. 3A, it can be seen that the fastening means illustrated correspond to a variant of those which have been described in FIG. 3. In this variant, the four connection arms form a plate which is cruciform. FIG. 3 shows these fastening means in the zone in which four adjacent primary insulation blocks are located. A disk 401 is arranged in a countersink of the rigid base plate of a primary insulation block, which base plate is adjacent to the sealing barrier. The plate which is generally designated 416 comprises a cross through the central zone of which there extends a protruding member 408*b* which is constituted, in the same manner as the previous embodiment, by a pin threaded at the free end thereof: this thread cooperates with a nut 409*b* and the base of the pin 408*b* is fixedly joined to the secondary insulation blocks by a plate (not illustrated) which is screwed to the rigid plates of the secondary insulation blocks; the cruciform plate 416 is fixedly joined to the rigid plate of the primary insulation blocks 13 by the ends of the four arms thereof as a result of a bolt arrangement 197 which abuts the disk 401 which is inserted during pre-production in a countersink of each rigid plate of the four adjacent primary insulation blocks 13. In this manner, the ends 196 of the arms of the cruciform plate 416 are bolted to the primary insulation blocks 13, the protruding member 408*b* is fixedly joined to the subjacent secondary insulation block 1, the pressing of one of the two blocks on the other being obtained by the screwing of the nut 409*b*. It is clear, as for the preceding embodiments, that the retention of the primary insulation barrier is thus carried out by acting from below on the rigid base plates 13*a* of the primary insulation blocks 13.

Figure 3B:
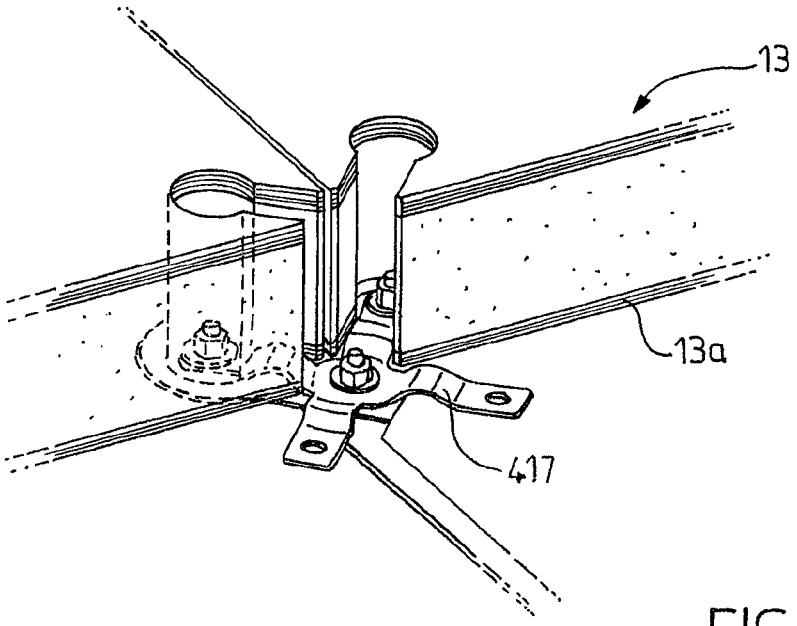

FIG. 3B shows a variant of FIG. 3A, in which there has been arranged on each of the arms of the cruciform plate a bending 417 which resiliently facilitates the movement of the primary insulation element 13 relative to the secondary insulation element 1. Of course, as in the previous case, the retention of the primary insulation barrier is carried out by acting from below on the rigid base plates 13*a* of the primary insulation blocks 13.

Figure 4:
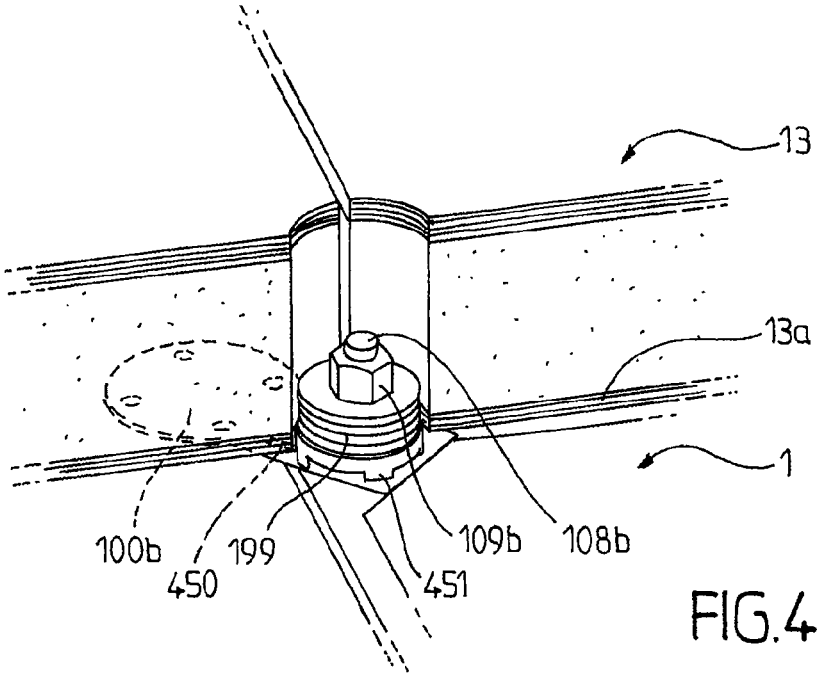
FIG. 4 is a perspective view of another variant of the fastening means in a zone of the tank wall similar to that of FIG. 3 or 3A, three of the four primary insulation blocks having been removed in order to leave the fastening means visible.

FIG. 4 illustrates another variant of the fastening means in a tank according to the invention. These fastening means are associated with four adjacent primary insulation blocks and, compared with FIG. 3, the connection arm is fused to the disk instead of being bolted thereto. In this variant, a disk is placed inside a countersink which is provided on the face of the rigid base of a primary insulation block, directed toward the secondary sealing barrier; this disk is fixed in the rigid plate of a primary insulation block. This disk 100*b* extends with a lug 450 which, at the side opposite the disk, is perforated in order to enable the passage of a protruding member 408*b*. The member 408*b* is a threaded pin whose free end carries a nut 109*b* and whose base is welded to a plate (which cannot be seen in the drawing) which is fixedly joined to a secondary insulation block 1. The nut 108*b* abuts with the lower face thereof a stack of washers 199; the base of the stack rests on a serrated disk 451; the slots of the disk 451 enable the passage of the lugs 450 which correspond to the four primary insulation blocks 1, which are distributed around the protruding member 108*b*. It can be seen that the clamping of the nut 109*b* presses, via the lugs 450, on the disks 100*b* so that the primary insulation blocks are pressed on the secondary insulation blocks. It is clear, as for the preceding embodiments, that the retention of the primary insulation barrier is thus carried out by acting from below on the rigid base plates 13*a* of the primary insulation blocks 13.

Figure 5:
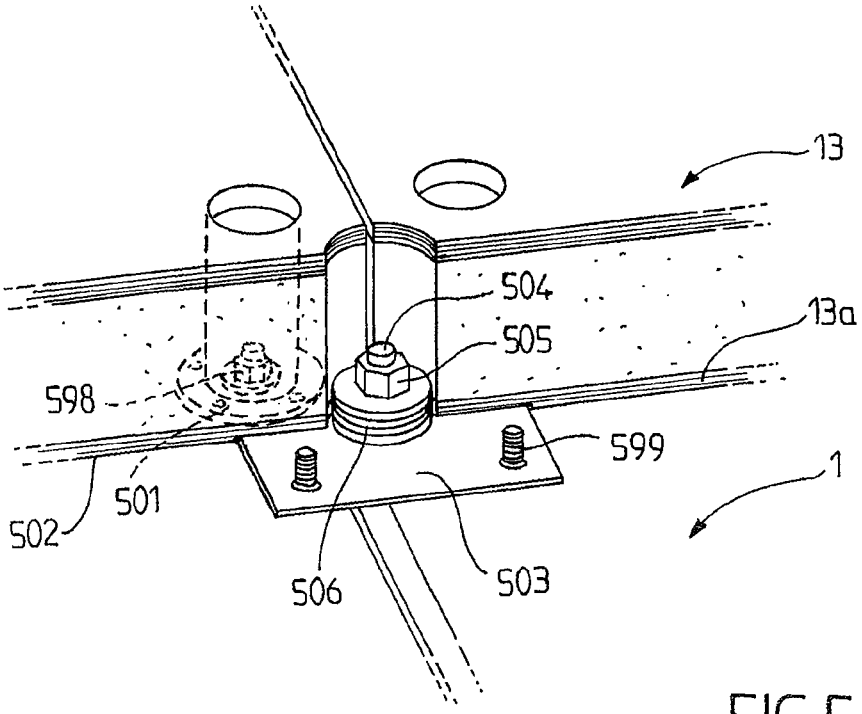
FIG. 5 is a perspective view, in a zone in which the meeting point of four adjacent primary insulation blocks is located, of another variant of the fastening means in which each of the four primary insulation blocks is connected mechanically to a corner of a spacer plate whose center is connected to the secondary insulation barrier.

FIG. 5 shows another variant of the fastening means which are capable of being used for four adjacent primary insulation blocks. These fastening means comprise four disks 501, each of which is located in a countersink of a rigid plate 13*a* of a primary insulation block 13; said plate is adjacent to the sealing barrier 502 and the countersink is provided at the side of the secondary sealing membrane 502. The four disks 501 are connected to each other via a spacer plate 503 which is perforated at the center thereof so that a protruding member 504 which is constituted by a pin which is threaded at the free end thereof can extend through it in order to cooperate with a nut 505. The base of the pin is welded at the center of a plate (not illustrated in the drawing) which is screwed into a countersink of the rigid plate of a secondary insulation block; said plate is covered by the secondary sealing barrier which is welded thereto all the way around the pin 504 in order to ensure the secondary sealing; the clamping of the nut 505 of the pin 504 applies to the spacer plate 503, via a stack of resilient washers 506, a force in the direction of the carrier wall in order to press the spacer plate onto the secondary sealing barrier. It has been found that the retention of the primary insulation barrier on the secondary insulation barrier is carried out by acting from below on the rigid base plates 13*a* of the primary insulation blocks 13 using nuts 598 which are screwed to threaded pins 599 carried by the spacer plate 503 in the region of the four corners thereof and engaged in a central hole of the corresponding disk 501 each time.

Figure 6:
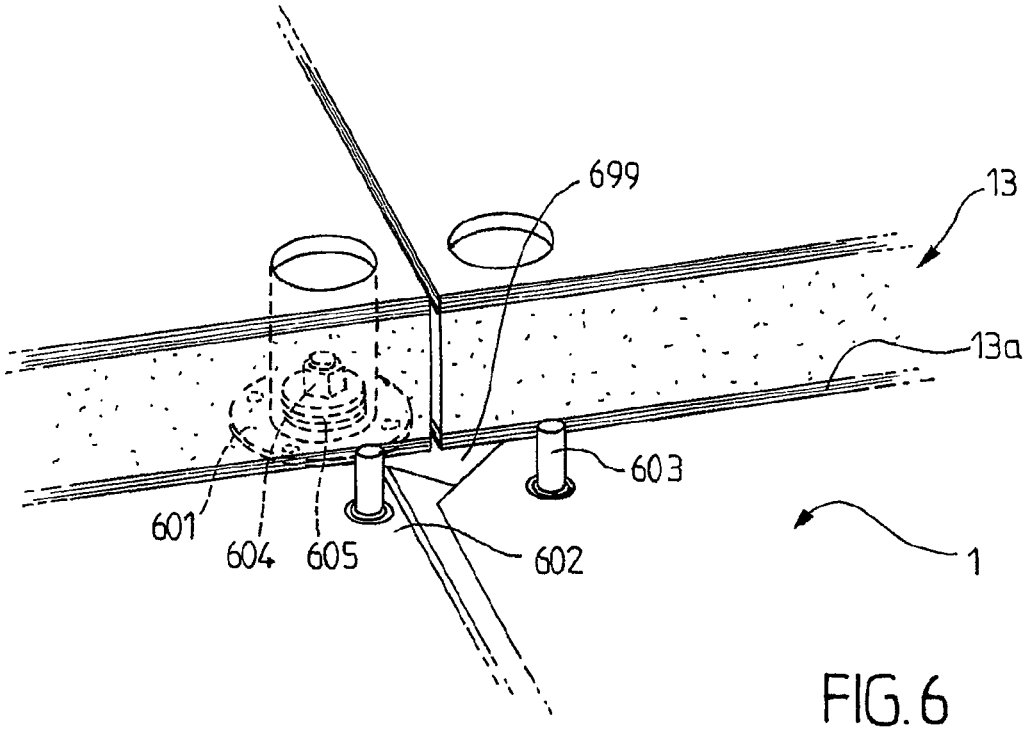
FIG. 6 shows a variant of FIG. 5 in which the mechanical connection which existed at the center of the spacer plate of FIG. 5 is moved to the four corners of a plate of the secondary sealing barrier in order to dispense with the central bolt of the variant of FIG. 5.

FIG. 6 shows the fastening means which are intended to cooperate with four adjacent primary insulation blocks. These means comprise four disks 601, each of which is held by means of screwing in a countersink of a rigid plate 13*a* of primary insulation blocks 13, the plate being the one which is adjacent to the sealing barrier 602, the countersink being formed at the side of the secondary sealing barrier. Each disk 601 is perforated at the center thereof in order to enable passage of a protruding member 603 which is constituted by a pin which is threaded at the free end thereof and which is welded via the base thereof to a plate 699 which is screwed into a countersink of the rigid plate of the secondary insulation block 1 which is located in the region of the pin 603. The pin 603 extends through the sealing barrier 602 and the sealing barrier is rewelded to the plate all the way around the pin in order to reestablish the sealing. A nut 604 cooperates with the thread of the pin 603 in order to apply to the disk 601 which corresponds to it, via a stack of resilient washers 605, a force which is directed toward the carrier wall of the tank.

Figure 7:
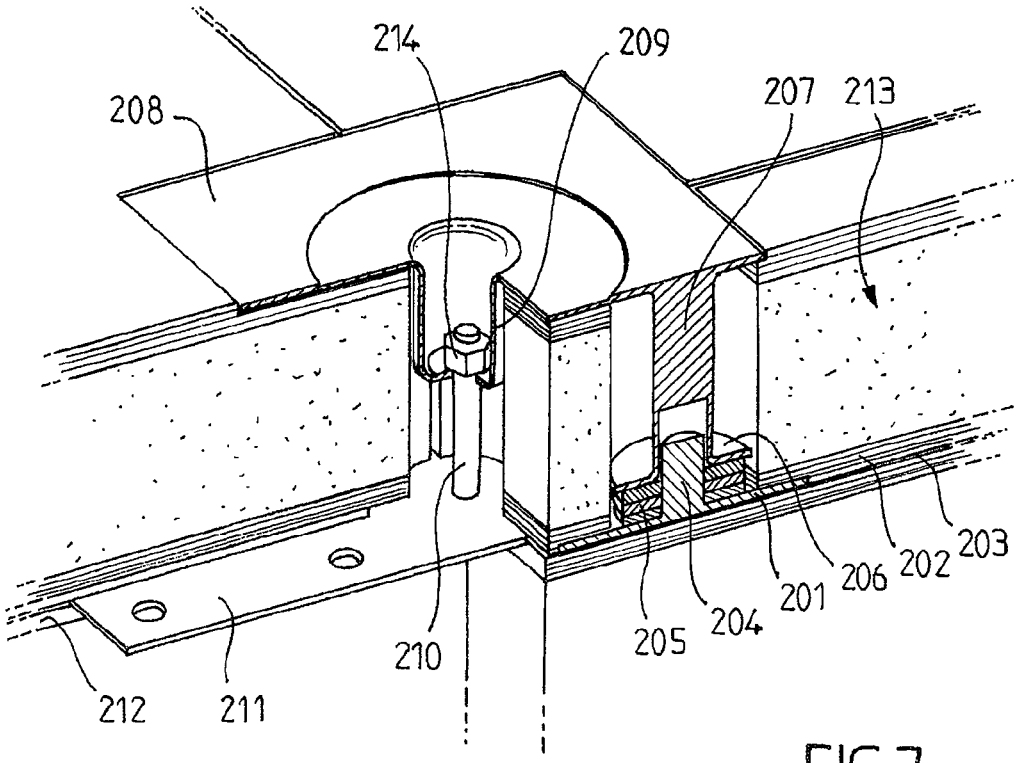
FIG. 7 is a perspective quarter-section, in the same wall zone as FIG. 5, of another embodiment of the fastening means in which the force applied from a plate of the primary sealing barrier is transmitted via a counter-plate which is positioned above the primary sealing blocks.

FIG. 7 shows fastening means in which the pressing action force of a primary insulation block on an adjacent secondary insulation block is transferred not directly into the zone corresponding to the rigid plates of the primary and secondary insulation blocks, but instead, using a supplementary component, above the primary insulation block. This embodiment is intended to be placed in the zone of the insulation barriers where four adjacent insulation blocks are located in an adjacent state. The metal plate 201 is fixed in a countersink of the rigid plate 202 of the primary insulation block 213, the rigid plate being the one which is adjacent to the secondary sealing barrier 203. The plate 201 carries a centering stud 204 which is directed toward the inner side of the primary insulation block 213; the stud 204 is in a housing of the primary insulation block 213, the housing allowing the introduction onto the stud 204 of resilient washers 205 which are surmounted by a disk 206 with a central perforation. On the disk 206, there is supported a hollow cylindrical foot 207 which is centered on the centering stud 204, said foot being fixedly joined, at the end thereof opposite the one which enables centering on the stud 204, to a counter-plate 208. The counter-plate 208 is placed above the primary insulation block 213, that is to say, at the side opposite the one at which the carrier wall of the tank is located. The counter-plate 208 comprises a central indentation 209, whose base is perforated in order to enable the passage of a member 210 which protrudes relative to the secondary barrier; the protruding member 210 is a pin whose base is fixedly joined to a plate 211 which is screwed into a rigid plate 212 of the secondary insulation barrier, the free end of the pin 210 cooperates with a nut 214 which abuts the base of the indentation 209. It can be seen that the clamping of the nut 214 brings about abutment of the edge of the support feet 207 with the washer 206 and therefore with the plate 201 with resilient washers 205 being interposed. The pressing of the primary insulation blocks 213 on the subjacent secondary insulation blocks is thus brought about. The central indentation 209, the support feet 207, the disks 206 and the washers 205 are arranged in recesses which have appropriate forms and positions and which are formed in the primary insulation blocks 213. It is clear that the retention of the primary insulation barrier is carried out in this embodiment by acting from below on the rigid base plates of the primary insulation blocks 13.

For all the production variants described above, it is very clear, since the positioning of the fastening means requires recesses to be formed in order to accommodate elements of the fastening means inside the primary insulation blocks, said recesses are filled with an insulation material as soon as the positioning is complete so that the thermal insulation is not reduced. Furthermore, the plates and small panels or the like which cooperate directly with the rigid plates of the primary and secondary insulation blocks are placed in countersinks which allow excess thicknesses to be prevented and any risk of damage to the secondary sealing barrier to be prevented in the event of a localized movement of the primary barrier relative to the secondary barrier, for example, when the tank is cooled.

It is also very clear, since the positioning of the fastening means described above brings about the need to perforate the secondary sealing membrane, this sealing is reestablished by welding after the positioning operation.

The tanks described above may be used in different types of installations such as land-based installations or in a floating structure such as an LNG tanker or the like.

Figure 8:
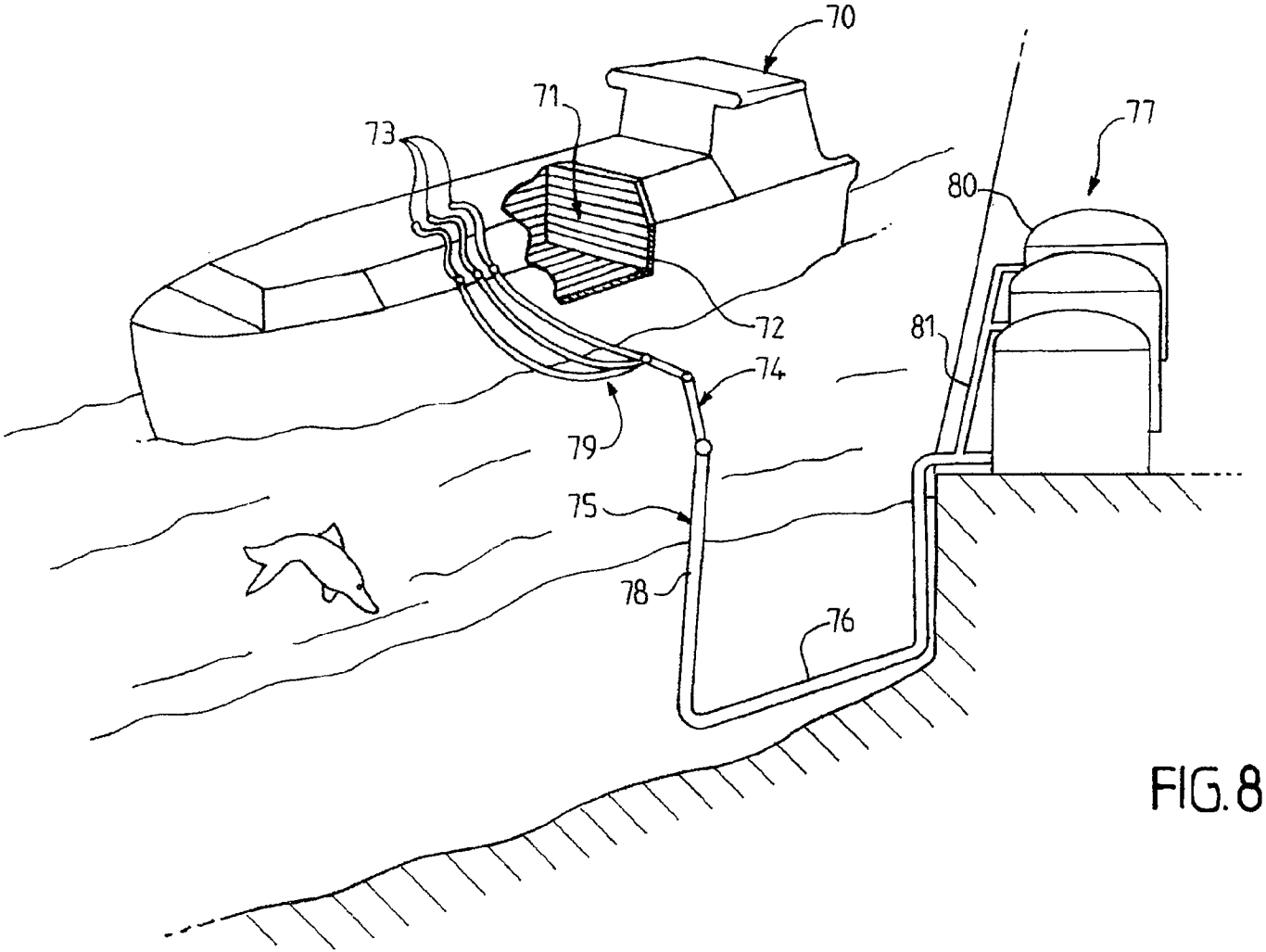
FIG. 8 is a cut-away schematic illustration of an LNG tanker tank and a terminal for loading/unloading this tank.

With reference to FIG. 8, a cut-away view of an LNG tanker 70 shows a sealed and insulated tank 71 of generally prismatic form which is mounted in the double hull 72 of the tanker. The wall of the tank 71 comprises a primary sealed barrier which is intended to be in contact with the LNG contained in the tank, a secondary sealed barrier arranged between the primary sealed barrier and the double hull of the tanker, and two thermally insulating barriers which are arranged between the primary sealed barrier and the secondary sealed barrier, respectively, and between the secondary sealed barrier and the double hull 72.

In a manner known per se, loading/unloading channels which are arranged on the upper bridge of the tanker may be connected, using appropriate connectors, to a sea or port-based terminal in order to transfer a cargo of LNG from or to the tank 71.

FIG. 8 shows an example of the sea-based terminal which comprises a loading and unloading station 75, an underwater conduit 76 and a ground-based installation 77. The loading and unloading station 75 is a fixed off-shore installation comprising a movable arm 74 and a tower 78 which supports the movable arm 74. The movable arm 74 carries a bundle of flexible insulated pipes 79 which can be connected to the loading/unloading channels 73. The movable arm 74 which can be orientated is adapted to all the gauges of LNG tankers. A connection conduit which is not illustrated extends inside the tower 78. The loading and unloading station 75 enables the loading and unloading of the LNG tanker 70 from or to a ground-based installation 77. This comprises storage tanks 80 for liquefied gas and connection conduits 81 which are connected via the underwater conduit 76 to the loading or unloading station 75. The underwater conduit 76 enables liquefied gas to be transferred between the loading or unloading station 75 and the ground-based installation 77 over a great distance, for example, 5 km, which enables the LNG tanker 70 to be kept at a great distance from the coast during the loading and unloading operations.

In order to produce the pressure required for the transfer of the liquefied gas, there are used pumps which are on-board the tanker 70 and/or pumps with which the land-based installation 77 is provided, and/or pumps with which the loading and unloading station 75 is provided.

Although the invention has been described in connection with several specific embodiments, it is evident that it is by no means limited thereto and that it comprises all the equivalent techniques of the means described and their combinations if they are included within the scope of the invention.

The use of the verb "comprise", "contain" or "include" and the conjugated forms thereof does not exclude the presence of elements or steps other than those set out in a claim. The use of the indefinite article "a" or "an" for an element or a step, unless otherwise stated, does not exclude the presence of a plurality of such elements or steps.

In the claims, any reference numeral in brackets should not be interpreted to be a limitation of the claim.

The invention claimed is:

1. A sealed and thermally insulating tank which is integrated in a structure which comprises a carrier wall, said tank comprising a tank wall which is fixed to said carrier wall, the tank wall comprising, on the one hand, a primary element and, on the other hand, a secondary element which is arranged between the carrier wall and the primary element, the primary element including a primary thermal insulation barrier which is constituted by primary insulation blocks in the form of rectangular parallelepipeds which are juxtaposed in parallel rows, the secondary element including a secondary thermal insulation barrier which is constituted by secondary insulation blocks in the form of rectangular parallelepipeds which are juxtaposed in parallel rows, the primary and secondary insulation blocks comprising a layer of plastics material foam which is clamped between two rigid insulation plates which delimit the insulation block, the two rigid insulation plates being substantially parallel with the carrier wall in a zone of the carrier wall in the region of which the two rigid insulation plates are located, the primary element including a primary sealing barrier which is arranged on the primary thermal insulation barriers, the secondary element including a secondary sealing barrier which is arranged on the secondary thermal insulation barrier, the secondary thermal insulation barrier being fixedly joined to the carrier wall, the primary thermal insulation barrier being fixedly joined to the secondary element of the tank by fastening means which are connected to the secondary thermal insulation barrier, and allowing the primary insulation blocks to be pressed onto the secondary insulation blocks of the secondary element of the tank wall, characterized in that four adjacent primary insulation blocks each comprise, in the region of a corner adjacent to the other three primary insulation blocks, a countersink being formed in a surface of a rigid insulation plate of said primary insulation block, wherein said rigid insulation plate is adjacent to the secondary sealing barrier and covers the secondary sealing barrier, wherein said surface of the rigid insulation plate is turned toward the secondary sealing barrier, and in that the fastening means comprise:

for each countersink of said four adjacent primary insulation blocks, a metal plate which is fixed in said countersink, the metal plate comprising at least one retention zone, a protruding member which is connected via a base thereof to a secondary insulation block which is facing the metal plates, and a connection element connecting said retention zone of the metal plate to the protruding member, the connection element comprising a retention zone which is in engagement with a stack of resilient washers which are engaged on the protruding member, a nut being screwed above the stack of resilient washers, the protruding member having a threaded head in order to cooperate with the nut, whose screwing applies to the retention zone of the metal plates, via the connection element, a force in the direction of the carrier wall.

2. The tank as claimed in claim 1, wherein the connection element is a connection arm.

3. The tank as claimed in claim 2, wherein the retention zone of the metal plate comprises a threaded stud which is welded to the metal plate which extends through an end portion of the connection arm and a nut cooperates with the thread of the stud in order to fix the end portion of the connection arm to the primary insulation block.

4. The tank as claimed in one of claim 1, wherein the primary sealing barrier and the secondary sealing barrier comprise adjacent metal sheets, wherein said adjacent metal sheets comprise at least two orthogonal undulations which are parallel with the sides of the thermal insulation blocks, the undulations being inserted into gaps which are provided between the insulation blocks.

5. The tank as claimed in claim 1, wherein the adjacent metal sheets of the primary sealing barrier are lap-welded and the adjacent metal sheets of the secondary sealing barrier are lap-welded.

6. A tanker for the transport of a cold liquid product, the tanker comprising a double hull and a sealed and thermally insulating tank as claimed in claim 1 wherein the double hull constitutes the structure which comprises the carrier wall.

7. Use of a tanker as claimed in claim 6 for loading or unloading a cold liquid product, wherein a liquid product is conveyed through insulated channels from or to a floating or land-based storage installation to or from the sealed and thermally insulating tank of the tanker.

8. A transfer system for a cold liquid product, the system comprising a tanker as claimed in claim 6, insulated channels which are arranged in order to connect the sealed and thermally insulating tank which is installed in the hull of the tanker to a floating or land-based storage installation and a pump for entraining a flow of cold liquid product through the insulated channels from or to the floating or land-based storage installation to or from the sealed and thermally insulating tank of the tanker.

* * * * *